United States Patent [19]

Scaggs

[11] 4,274,777

[45] Jun. 23, 1981

[54] SUBTERRANEAN WELL PIPE GUIDING APPARATUS

[76] Inventor: Orville C. Scaggs, Box 430, Lindsay, Okla. 73052

[21] Appl. No.: 42,001

[22] Filed: May 24, 1979

Related U.S. Application Data

[63] Continuation-in-part of Ser. No. 931,150, Aug. 4, 1978.

[51] Int. Cl.[3] ..... E21B 19/14

[52] U.S. Cl. ..... 414/22; 414/745; 414/739; 294/88; 294/106

[58] Field of Search ..... 414/22, 745, 730, 739, 414/783, 910; 175/52, 85; 294/88, 106, 110 R, 110 A

[56] References Cited

U.S. PATENT DOCUMENTS

| | | | |
|---|---|---|---|
| 2,692,059 | 10/1954 | Bolling, Jr. | 414/22 |
| 2,828,024 | 3/1958 | True | 414/22 |
| 2,829,783 | 4/1958 | Blagg | 414/22 |
| 3,627,372 | 12/1971 | Carpenter | 294/88 |
| 3,945,676 | 3/1976 | Asamoto | 294/88 |
| 4,172,684 | 10/1979 | Jenkins | 414/22 |

*Primary Examiner*—Allen N. Knowles
*Attorney, Agent, or Firm*—Robert M. Hessin

[57] ABSTRACT

An improved pipe guiding apparatus for vertically aligning pipe section joints in a derrick having a worktable and an elevator for vertically suspending at least one pipe section above the worktable. The apparatus is comprised of a rotary axle for horizontal attachment in the derrick, a frame attached to the rotary axle, a power cylinder for rotating the rotary axle, a pair of guide jaws pivotally attached to the forward end of the frame, a cylinder for moving the guide jaws between open and closed positions attached thereto and control for remotely operating the power cylinder for rotating the axle and the cylinder for moving the guide jaws so that that frame can be selectively moved to a position whereby the guide jaws are adjacent a vertically suspended pipe section and the guide jaws thereafter closed on the pipe section.

6 Claims, 5 Drawing Figures

SUBTERRANEAN WELL PIPE GUIDING APPARATUS

CROSS-REFERENCE TO RELATED APPLICATION

This application is a continuation-in-part of Application Ser. No. 931,150 filed Aug. 4, 1978.

BACKGROUND OF THE INVENTION

1. Field of the Invention

This invention relates generally to an improved subterranean well pipe guiding apparatus, and more particularly, but not by way of limitation, to improved apparatus for vertically aligning pipe section joints in a derrick.

2. Description of the Prior Art

In the drilling, completion and work-over of oil, gas and water wells, it is necessary to remove and install strings of pipe sections in the well bore. In all such operations where pipe sections are installed, a rig or derrick having a work floor or table and an elevator for vertically suspending one or more pipe sections above the worktable is utilized. One or more pipe sections are lowered into the well bore to a position where the uppermost threaded box end of the upper pipe section is positioned a short distance above the worktable whereupon the pipe sections are clamped in that position by means of wedge apparatus known as slips. One or more additional pipe sections are then vertically suspended in the derrick by means of the elevator and the lowermost threaded end of the pipe sections suspended in the derrick are threadedly connected to the upper threaded box end of the pipe sections in the well bore. The slips holding the pipe sections are then removed and the joined pipe sections are lowered into the well bore. The process of joining additional pipe sections to the string of pipe sections in the well bore and lowering the string is repeated until the string is of the required total length. When the pipe sections are threadedly connected it is extremely important that the lowermost pipe sections suspended in the derrick be aligned vertically with the upper pipe section in the well bore whereby the threads are joined without damage due to cross-threading, etc. While various devices and apparatus have been developed heretofore for steadying and guiding pipe sections suspended in the derrick, they either do not prevent the suspended pipe sections from bowing or are difficult to operate whereby additional time is required for effecting the pipe section joinder.

By the present invention an improved pipe guiding and aligning apparatus is provided which effectively guides the suspended pipe sections, prevents the sections from bowing and is easily and effectively operated from the derrick floor.

SUMMARY OF THE INVENTION

An improved pipe guiding apparatus for vertically aligning pipe section joints in a derrick having a worktable and an elevator for vertically suspending at least one pipe section above the worktable comprising a rotary axle means for horizontal attachment to the derrick at a selected elevation above the worktable thereof, a frame having a forward end and a rearward end, the rearward end of the frame being attached to the rotary axle means whereby when the axle means are rotated, the forward end of the frame swings in a vertical arc, means for rotating the axle of the rotary axle means attached thereto, a pair of guide jaws pivotally attached to the forward end of the frame, means for moving the guide jaws between open and closed positions attached to the guide jaws and to the frame and means for remotely operating the means for rotating the axle and the means for moving the guide jaws attached thereto so that the axle can be selectively rotated to position the frame whereby the guide jaws are adjacent the vertically suspended pipe section and the guide jaws are thereafter closed on the pipe section.

It is, therefore, a general object of the present invention to provide an improved subterranean well pipe guiding apparatus.

It is a further object of the present invention to provide an improved pipe guiding apparatus which is actuatable from the derrick floor and effectively guides and aligns one or more pipe sections suspended in the derrick whereby threaded engagement of said sections with additional pipe sections extending into the well bore can be effected without damage to the threads thereof.

Yet a further object of the present invention is the provision of a pipe guiding apparatus which positively engages one or more suspended pipe sections at a point above the derrick floor whereby the pipe section cannot accidentally slip out of or otherwise become disengaged with the pipe guiding apparatus due to bowing of the pipe sections, etc.

Other and further features, advantages and objects of the apparatus of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
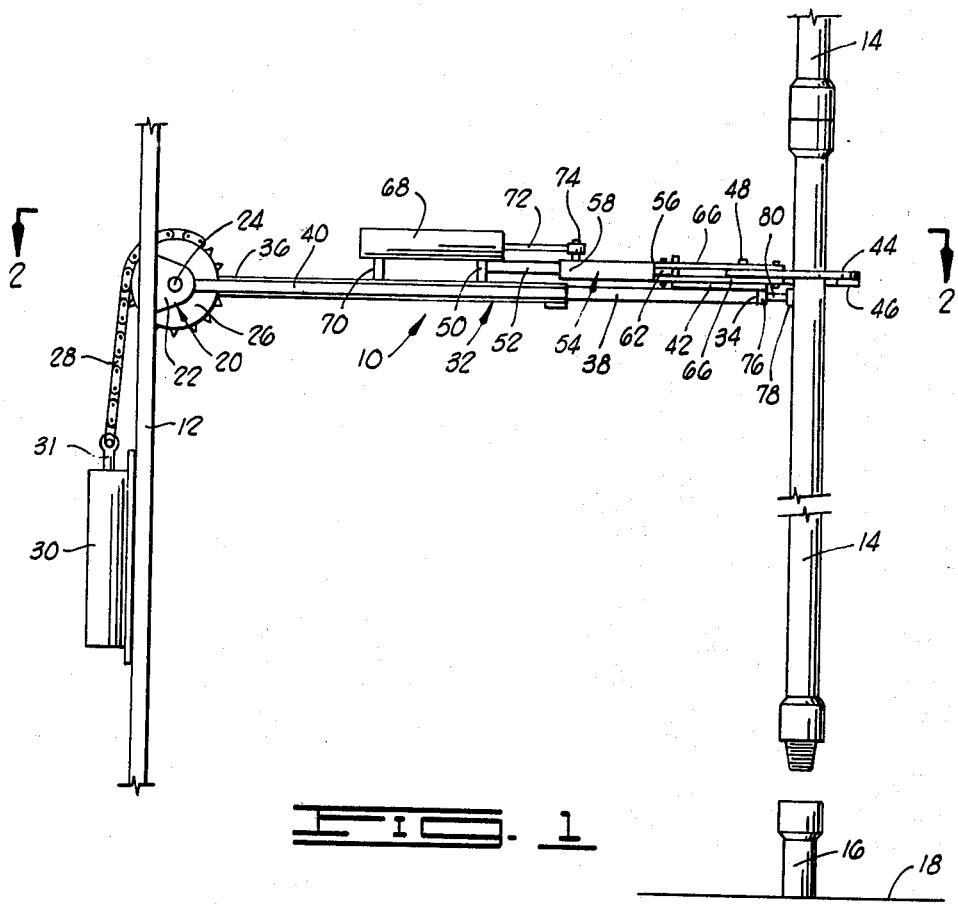
FIG. 1 is a side elevational view of the improved pipe guiding apparatus of the present invention mounted in a derrick and engaging a pair of pipe sections suspended in the derrick above the derrick floor.
Figure 2:
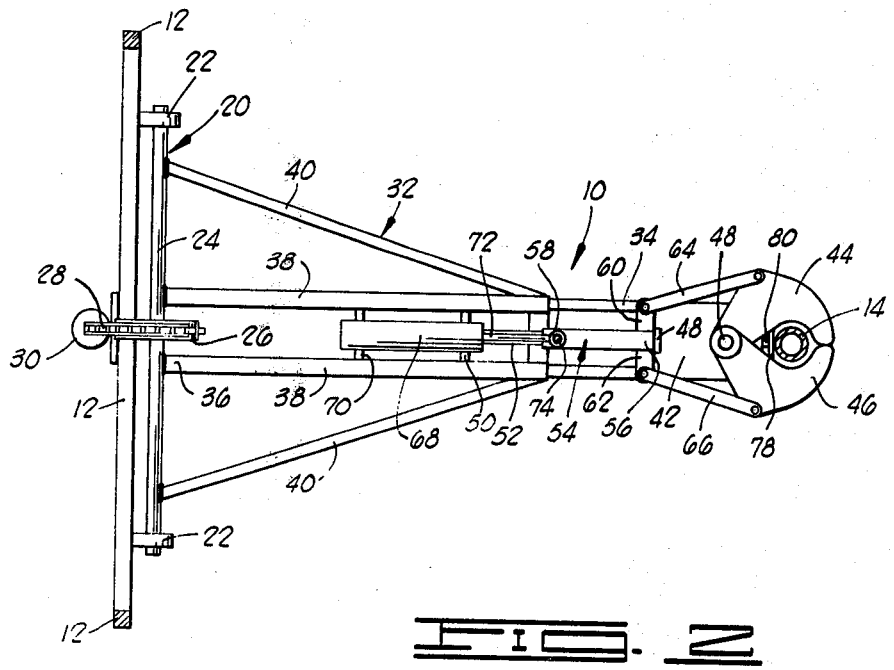
FIG. 2 is a top view of the apparatus of FIG. 1 taken along line 2—2 of FIG. 1.
Figure 3:
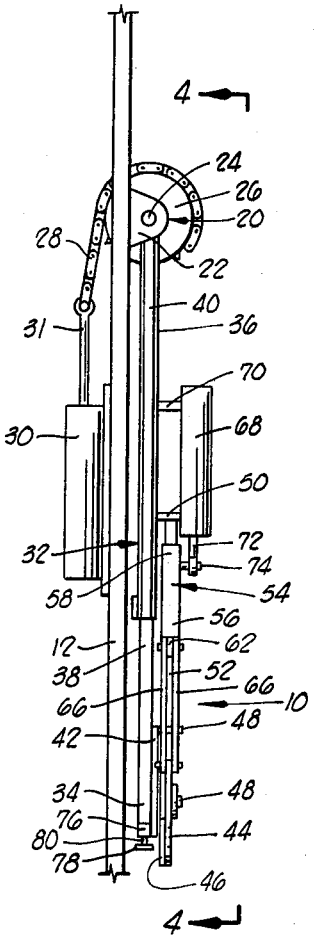
FIG. 3 illustrates the apparatus of FIG. 1 in a lowered position with the guide jaws thereof in the open position.
Figure 4:
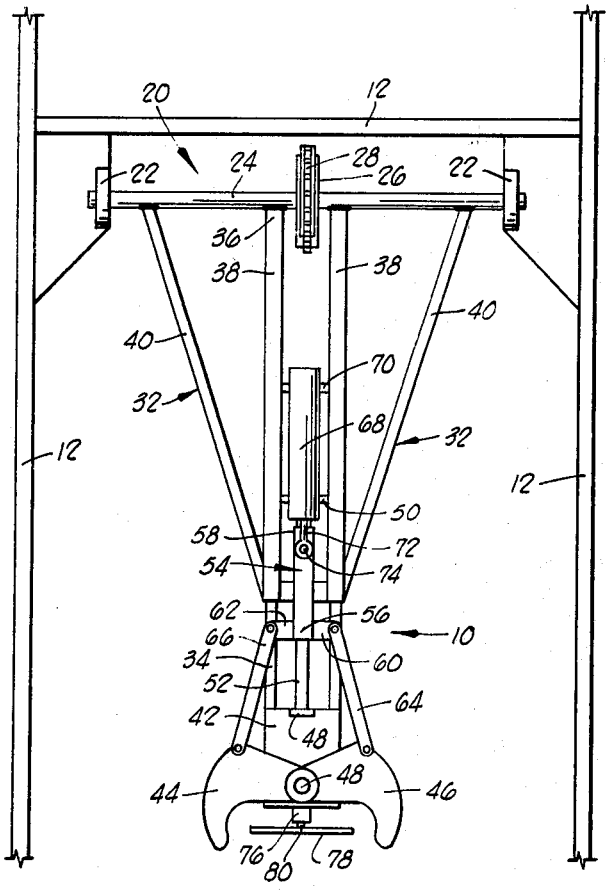
FIG. 4 is a top view of the apparatus of FIG. 3 taken along line 4—4 of FIG. 3.

Referring now to the drawings, and particularly to FIGS. 1 through 4, the apparatus of the present invention is illustrated and generally designated by the numeral 10. In FIGS. 1 and 2, the apparatus 10 is shown mounted to structural members 12 of a derrick and engaging a pair of suspended pipe sections 14 whereby the pipe sections are aligned with the uppermost threaded box end of a pipe section 16 clamped in the derrick floor or worktable 18. In FIGS. 3 and 4, the apparatus 10 is illustrated in the lowered and disengaged position.

The apparatus 10 is comprised of rotary axle means, generally designated by the numeral 20, adapted for horizontal attachment to the structural members 12 of a ig or derrick. The rotary axle means 20 include a pair f journal boxes 22 adapted for attachment to the structural members 12 by bolting, welding, etc. A horizontal xle 24 is journaled within and between the journal oxes 22 and a sprocket 26 is attached to the axle 24. A hain 28 adapted to engage the teeth of the sprocket 26 provided, one end of which is attached to the procket 26 and the other end attached to the operative rm 31 of a conventional fluid pressure operated power ylinder 30. As will be understood, a variety of linkages etween the power cylinder 30 and the axle 24 of the pparatus 10 can be utilized in lieu of the sprocket and hain arrangement illustrated in the drawings so long as he linkage used and power cylinder 30 are capable of otating the axle 24 through at least 90°.

A frame, generally designated by the numeral 32, aving a forward end 34 and a rearward end 36 is provided, the rearward end 36 being attached to the axle 24 f the rotary axle means 20. The frame 32 can take a ariety of forms and in the embodiment illustrated in he drawings includes a pair of elongated frame members 38 positioned parallel to each other, the rearward nds of which are welded or otherwise attached to the xle 24. A pair of additional frame members 40 are ttached to the axle 24 at their rearward ends and to the rame members 38 at their forward ends to provide verall strength and rigidity to the frame 32.

A flat horizontally positioned plate 42 is attached to he top surface of the frame members 38 at the forward nd 34 of the frame 32. Pivotally attached to the plate 42 re a pair of guide jaws 44 and 46. The guide jaws 44 nd 46 are each of a generally crescent shape with the earward ends thereof pivotally attached to the plate 42 y means of a pin 48. The guide jaws 44 and 46 are ositioned so that when in the closed position as illustrated in FIGS. 1 and 2, the concave portions thereof ace each other and form a generally circular enclosure within which the pipe section 14 is engaged and confined.

An upstanding plate 48 is provided attached to the late 42 and an upstanding plate 50 positioned rearwardly of the plate 48 is attached to the frame members 8. Positioned between and attached to the plates 48 and 0 is a shaft 52, and slidably positioned on the shaft 52 is sleeve member 54 having a forward end 56 and a earward end 58. Attached to the forward end 56 of the leeve member 54 are a pair of horizontally positioned utwardly extending lugs 60 and 62. A pair of linking nembers 64 are pivotally attached to the lug 60 and a air of linking members 66 are pivotally attached to the ug 62. The forward ends of the linking members 64 are ivotally attached to the guide jaw 44 and the forward nds of the linking members 66 are pivotally attached to he guide jaw 46.

A second pressurized fluid operated power cylinder 8 is mounted on the upstanding plate 50 and a second late 70 both of which are attached to the frame members 38 of the frame 32. The operating arm 72 of the ower cylinder 68 is connected to the rearward end 58 f the sleeve 54 by means of a pin 74.

A two-way spring loaded valve 76 is attached to the orward end 34 of the frame 32 having a contact plate 78 attached to the operating shaft 80 thereof. The contact plate 78 can take various forms but preferably is elongated horizontally whereby it spans a major portion f the distance between the guide jaws 44 and 46 when n the open position.

Figure 5:
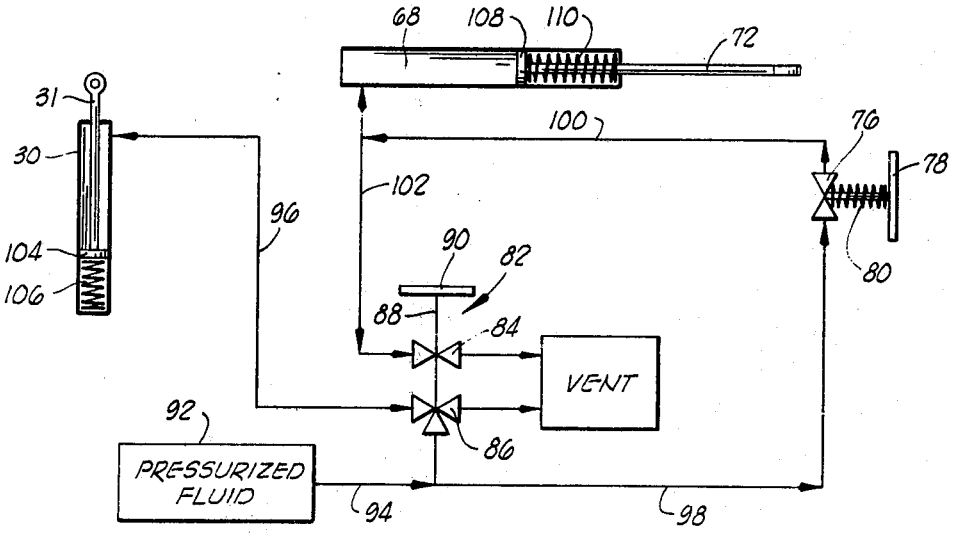
FIG. 5 is a schematic view of one form of control system which can be used to effect the operation of the apparatus of FIGS. 1–4.

Referring now to FIG. 5, one form of conduit and valve control system which can be utilized for effecting the remote control and operation of the apparatus 10 is illustrated diagrammatically. The first and second power cylinders 30 and 68 described above and illustrated in FIGS. 1–4 are shown in FIG. 5 as is the two-way valve 76, and the operating shaft 80 and contact plate 78 thereof. A foot operated valve assembly, generally designated by the numeral 82, is provided including a two-way valve 84 and a three-way valve 86 operated by a single shaft 88 to which a foot plate 90 is attached. As will be understood, the valve assembly 82 is of conventional construction and includes a latching mechanism or the equivalent whereby when the foot pedal 90 is depressed the valves 84 and 86 are moved to one position until the foot pedal is again depressed which causes the valves 84 and 86 to change position.

A source of pressurized fluid 92, such as pressurized air, is connected to an inlet port of the three-way valve 86 of the valve assembly 82 by a conduit or hose 94. One of the outlet ports of the three-way valve 86 is connected to the power cylinder 30 by conduit or hose 96. The inlet port of the valve 76 is connected to the conduit or hose 94 by a conduit or hose 98 and the outlet port of the two-way valve 76 is connected to the pressurized fluid inlet connection of the power cylinder 68 by a conduit or hose 100. One of the ports of the two-way valve 84 of the foot operated valve assembly 82 is connected to the conduit or hose 100 by a conduit or hose 102 and the other port of the two-way valve 84 and one of the outlet ports of the three-way valve 86 of the assembly 82 are open to the atmosphere or connected to a vent. As shown in FIG. 5, the power cylinder 30 includes a piston 104 connected to the operating arm 31 thereof and a spring 106 positioned on the opposite side of the piston 104 whereby when pressurized fluid is communicated to the cylinder 30 by way of the conduit or hose 96, the operating arm 31 is moved downwardly and when the pressurized fluid is exhausted from the cylinder 30, the operating arm 31 is moved upwardly by the spring 106. In like manner, the second power cylinder 68 includes a piston 108 connected to the operating arm 72 thereof and a spring 110 is disposed in the cylinder 68 whereby when pressurized fluid is conducted to the power cylinder 68 by way of the conduit or hose 100, the operating arm 72 is extended and when the pressurized fluid is exhausted from the cylinder 68, the spring 110 causes the operating arm 72 to be retracted.

OPERATION OF THE APPARATUS 10

In operation of the apparatus 10, and referring to FIGS. 1, 2 and 5, when one or more pipe sections 14 are suspended in a derrick and are positioned over one or more pipe sections 16 extending within the well bore of a well with the top threaded box end positioned above the derrick floor 18 as illustrated in FIG. 1, the foot operated valve assembly 82 is operated whereby pressurized fluid, such as pressurized air, is caused to flow from the source 92 thereof by way of the conduit or hose 94 through the three-way valve 86 and into the power cylinder 30 by way of the conduit or hose 96. The introduction of pressurized fluid into the power cylinder 30 causes the operating arm 31 thereof to move downwardly which in turn moves the chain 28 downwardly and causes the sprocket 26 and the axle 24 thereof to rotate whereby the frame 32 and the guide jaws 44 and 46 attached thereto are moved from a lowered position (FIG. 3) to a horizontal position (FIG. 1).

The guide jaws 44 and 46 remain in the open position as illustrated in FIG. 4 until the suspended pipe sections 14 are brought into contact with the contact plate 78 of the two-way valve 76 attached to the forward end 34 of the frame 32. When the pipe sections 14 contact the contact plate 78, the shaft 80 connected thereto, is moved inwardly which opens the two-way valve 76 and causes pressurized fluid conducted to the valve 76 by way of the conduit or hose 98 to flow through the conduit or hose 100 into the power cylinder 68. The introduction of pressurized fluid into the power cylinder 68 causes the operating arm 72 thereof to be extended which in turn moves the sleeve 54 forwardly on the shaft 52. With the movement of the sleeve 52 forwardly, the linking members 64 and 66 are also moved forwardly which causes the guide jaws 44 and 46 to be pivoted around the pin 48 and to close on one of the pipe sections 14 as illustrated in FIGS. 1 and 2. Once the apparatus 32 has engaged the suspended pipe sections 14, the pipe sections 14 are aligned with the pipe sections 16 and the pipe sections 14 are prevented from bowing whereby the threaded joints of the pipe sections 14 and 16 can be engaged without damaging the threads thereof. Once the joinder of the pipe sections 14 and 16 has been completed, the foot operated valve assembly 82 is again operated which changes the position of the two-way valve 84 and three-way valve 86 thereof whereby the power cylinder 30 is communicated to the atmosphere or to a vent by way of the conduit or hose 96 and the valve 86. Simultaneously, the valve 84 is opened whereby the power cylinder 68 is communicated to the atmosphere or to a vent by way of the conduit or hose 102. The venting of the power cylinders 30 and 68 causes the operating arm 31 of the power cylinder 32 to be moved upwardly which in turn lowers the frame 32 and the operating arm 72 of the power cylinder 68 to be retracted which opens the guide jaws 44 and 46. The elevator of the derrick is then lowered whereby the pipe sections 14 joined with the pipe sections 16 are lowered into the well bore and the uppermost threaded joint of the pipe sections 16 positioned at the worktable 18 of the derrick. Additional pipe sections are then suspended in the derrick and the apparatus 10 is again operated in the manner described above to align the pipe sections while they are being joined.

Thus, the apparatus of the present invention is well adapted to carry out the objects and attain the ends mentioned as well as those inherent therein. While numerous changes in the construction and arrangement of parts, such as the use of a remote control system which utilizes hydraulic fluid rather than pressurized air, will suggest themselves to those skilled in the art, such changes are encompassed within the spirit of this invention as defined by the appended claims.

What is claimed is:

1. An improved pipe guiding apparatus for vertically aligning pipe section joints in a derrick having a worktable and an elevator for vertically suspending at least one pipe section above said worktable comprising:

rotary axle means for horizontal attachment to the derrick at a location above the worktable thereof;

a frame having a forward end and a rearward end, the rearward end of said frame being attached to said rotary axle means whereby when said axle means are rotated the forward end of said frame swings in a vertical arc;

means for rotating the axle of said rotary axle means to rotate said frame;

a pair of guide jaws pivotally attached to the forward end of said frame;

cylinder means attached to said guide jaws and to said frame for moving said guide jaws between open and closed positions; and means for remotely operating said means for rotating said axle and said cylinder means so that said axle can be selectively rotated to position said frame whereby said guide jaws are adjacent a vertically suspended pipe section and said guide jaws are thereafter closed to secure said pipe section along a preselected vertical alignment.

2. The apparatus of claim 1 wherein said means for rotating the axle of said rotary axle means comprise:

first power cylinder means; and linkage means attached to said power cylinder means and to the axle of said rotary axle means to rotate said axle through approximately 90°.

3. The apparatus of claim 2 wherein said linkage means comprises sprocket gear and chain means secured to said axle and to said power cylinder means.

4. The apparatus of claim 2 wherein said cylinder means for moving said guide jaws between open and closed positions are comprised of second power cylinder means attached to said frame and to said guide jaws.

5. The apparatus of claim 4 wherein said means for remotely operating said means for rotating said axle and for moving said guide jaws comprise:

a source of pressurized fluid;

conduit means for leading pressurized fluid from said source to said first and second power cylinder means;

manually operated valve means disposed in said conduit means and positioned adjacent said worktable of said derrick for selectively rotating said axle of said rotary axle means and for moving said guide jaws to the open position; and contact operated valve means disposed in said conduit means attached to the forward end of said frame and positioned to contact a pipe section when said guide jaws are positioned adjacent a vertically suspended pipe section whereby said guide jaws are closed on said pipe section.

6. The apparatus of claim 5 wherein said guide jaws are each of crescent shape and are pivotally attached to said frame at one end thereof, the concave portions of said guide jaws facing each other when in the closed position.

* * * * *